United States Patent [19]

Koch et al.

[11] Patent Number: 4,948,686

[45] Date of Patent: Aug. 14, 1990

[54] PROCESS FOR FORMING TWO-COLOR IMAGES

[75] Inventors: Ronald J. Koch, Webster; Robert J. Gruber, Pittsford; Paul C. Julien, Webster; Donald J. Goodman, Rochester; Edward J. Gutman, Webster; Deepak R. Maniar, Penfield, all of N.Y.

[73] Assignee: Xerox Corporation, Stamford, Conn.

[21] Appl. No.: 342,132

[22] Filed: Apr. 24, 1989

[51] Int. Cl.[5] ..... G03G 13/01; G03G 13/09

[52] U.S. Cl. ..... 430/45; 430/122

[58] Field of Search ..... 430/42, 45, 122

[56] References Cited

U.S. PATENT DOCUMENTS 4,430,402 2/1984 Tsushima ..... 430/45
4,525,447 6/1985 Tanaka et al. ..... 430/122
4,539,281 9/1985 Tanaka et al. ..... 430/45
4,562,129 12/1985 Tanaka et al. ..... 430/42
4,640,883 2/1987 Oka ..... 430/120 X

FOREIGN PATENT DOCUMENTS 56-83760 7/1981 Japan ..... 430/45

*Primary Examiner*—Roland E. Martin
*Attorney, Agent, or Firm*—Judith L. Byorick

[57] ABSTRACT

Disclosed is a process for forming two-color images which comprises charging an imaging member, creating on the member a latent image comprising areas of high, medium, and low potential, developing the low areas of potential with a developer comprising a specific colored toner and a specific carrier as described herein, subsequently developing the high areas of potential with a developer comprising a specific black toner and a specific carrier as described herein, transferring the developed two-color image to a substrate, and permanently affixing the image to the substrate.

70 Claims, No Drawings

PROCESS FOR FORMING TWO-COLOR IMAGES

BACKGROUND OF THE INVENTION

The present invention is directed to a process for forming two-color images. More specifically, the present invention is directed to a process for forming two-color images which comprises charging an imaging member, creating on the member a latent image comprising areas of high, medium, and low potential, developing the low areas of potential with a developer comprises a specific colored toner and a specific carrier as described herein, subsequently developing the high areas of potential with a developer comprising a specific black toner and a specific carrier as described herein, transferring the developed two-color image to a substrate, and optionally permanently affixing the image to the substrate. One advantage of the process of the present invention is the ability to generate high quality two-color images in a single development pass, particularly as a result of the absence of interaction between the black and color developers.

Processes for forming two-colored images are known. For example, U.S. Pat. No. 4,264,185, the disclosure of which is totally incorporated herein by reference, discloses an apparatus for forming two color images by forming a bipolar electrostatic image of a two color original document on a photoconductive drum. A first developing unit applies a toner of a first color and polarity to the drum and a second developing unit applies a toner of a second color and polarity to the drum to form a two color electrostatic image which is transferred and fixed to a copy sheet. A bias voltage of the first polarity is applied to the second developing unit to repel the toner of the first color and polarity against the drum and prevent degradation of the first color toner image. A bias voltage of the second polarity is applied to the first developing unit to prevent contamination of the first color toner with the second color toner.

In addition, U.S. Pat. No. 4,308,821 discloses a method and apparatus for forming two-color images which employs two magnetic brushes. The first developed image is not disturbed during development of the second image, since the second magnetic brush contacts the surface of the imaging member more lightly than the first magnetic brush, and the toner scraping force of the second magnetic brush is reduced in comparison with that of the first magnetic brush by setting the magnetic flux density on a second non-magnetic sleeve with an internally disposed magnet smaller than the magnetic flux density on a first magnetic sleeve, or by adjusting the distance between the second non-magnetic sleeve and the surface of the imaging member. In addition, the toners may have different quantities of electric charge.

Further, U.S. Pat. No. 4,378,415 discloses a method of highlight color imaging which comprises providing a layered organic photoreceptor having a red sensitive layer and a short wavelength sensitive layer, subjecting the imaging member to negative charges, followed by subjecting the imaging member to positive charges, imagewise exposing the member, and developing with a colored developer composition comprising positively charged toner components, negatively charged toner components, and carrier particles. Another U.S. Pat. No. 4,430,402, discloses a two-component type dry developer for use in dichromatic electrophotography which comprises two kinds of developers, each of which consists of a toner and a carrier. Dichromatic images are formed by developing a both positively and negatively electrified electrostatic latent image successively with toners different in polarity and color from each other, wherein one carrier becomes positively charged by friction with either of the two toners while the other carrier becomes negatively charged by friction with either of the two toners.

Additionally, U.S. Pat. No. 4,594,302 discloses a developing process for two-colored electrophotography which comprises charging the surface of a photoreceptor with two photosensitive layers of different spectral sensitivities with one polarity, subsequently charging the photoreceptor with a different polarity, exposing a two-colored original to form electrostatic latent images having different polarities corresponding to the two-colored original, developing one latent image with a first color toner of one polarity, exposing the photoreceptor to eliminate electric charges with the same polarity as the first color toner which are induced on the surface of the photoreceptor in the vicinity of the latent image developed by the first color toner, and developing the other latent image with a second color toner charged with a polarity different from that of the first color toner.

In addition, U.S. Pat. No. 4,500,616 discloses a method of developing electrostatic latent images by selectively extracting colored grains of one polarity from a mixture containing colored grains having opposite polarity to each other in the presence of an alternating field, followed by development of the electrostatic image by the selectively extracted colored grains. Further, U.S. Pat. No. 4,524,117 discloses an electrophotographic method for forming two-colored images which comprises uniformly charging the surface of a photoreceptor having a conductive surface and a photoconductive layer sensitive to a first color formed on the conductive substance, followed by exposing a two-colored original to form on the photoconductive layer a latent image corresponding to a second color region in the original with the same polarity as the electric charges on the surface of the photoconductive layer. The photoreceptor surface is then subjected to a reversal development treatment by the use of a photoconductive color toner charged with the same polarity as the electric charges constituting the latent image, to develop the non-charged region with the photoconductive toner. The latent image is then subjected to normal development treatment with an insulative toner having a color different from the color of the photoconductive toner. Subsequently, the color toners on the photoconductive layer are charged with a different polarity from the charging polarity and, simultaneously, the original is exposed through a filter shielding against the first color, thereby forming a two-colored image.

Another U.S. Pat. No. 4,525,447, the disclosure of which is totally incorporated herein by reference, discloses an image forming method which comprises forming on a photosensitive member an electrostatic latent image having at least three different levels of potentials, or comprising first and second latent images and developing the first and second latent images with a three component developer. The developer comprises a magnetic carrier, a first toner chargeable to one polarity by contact with the magnetic carrier, and a second toner chargeable to a polarity opposite to that of the first toner by contact with the first toner, but substantially not chargeable by contact with the magnetic carrier.

Further, U.S. Pat. No. 4,539,281 discloses a method of forming dichromatic copy images by forming an electrostatic latent image having a first image portion and a second image portion. The first image portion is developed by a first magnetic brush with a magnetic toner of a first color that is chargeable to a specific polarity, and the second image portion is developed by a second magnetic brush with a mixture of a magnetic carrier substantially not chargeable with the magnetic toner and a non-magnetic toner of a second color chargeable to a polarity opposite to that of the magnetic toner by contact with the magnetic carrier.

Additionally, U.S. Pat. No. 4,562,129, the disclosure of which is totally incorporated herein by reference, discloses a method of forming dichromatic copy images with a developer composed of a high-resistivity magnetic carrier and a nonmagnetic insulating toner which are triboelectrically chargeable. An electrostatic latent image having at least three different levels of potential is formed and the toner and carrier are adhered respectively onto the first and second image portions. In addition, U.S. Pat. No. 4,640,883, the disclosure of which is totally incorporated herein by reference, discloses a method of forming composite or dichromatic images which comprises forming on an imaging member electrostatic latent images having at least three different potential levels, the first and second latent images being represented respectively by a first potential and a second potential relative to a common background potential. The first and second images are developed by a first magnetic brush using two kinds of toners, at least one of which is magnetic, and both of which are chargeable to polarities opposite to each other, with application to a developing electrode of a bias voltage capable of depositing the magnetic toner on the backdround potential area, to deposit selectively the two toners on the first and second latent images and to deposit the magnetic toner on the background potential area, while collecting the deposited magnetic toner at least from the background potential area by second magnetic brush developing means.

Other representative patents of interest with respect to formation of two-color images include U.S. Pat. Nos. 4,045,218 and 4,572,651.

The process of charging a photoresponsive imaging member to a single polarity and creating on it an image consisting of at least three different levels of potential of the same polarity is disclosed in U.S. Pat. No. 4,078,929, the disclosure of which is totally incorporated herein by reference. This patent discloses a method of creating two colored images by creating on an imaging surface a charge pattern including an area of first charge as a background area, a second area of greater voltage than the first area, and a third area of lesser voltage than the first area, with the second and third areas functioning as image areas. The charge pattern is developed in a first step with positively charged toner particles of a first color, and, in a subsequent development step, developed with negatively charged toner particles of a second color. Alternatively, charge patterns may be developed with a dry developer containing toners of two different colors in a single development step. According to the teachings of this patent, however, the images produced are of inferior quality compared to those developed in two successive development steps. Also of interest with respect to the tri-level process for generating images is U.S. Pat. No. 4,686,163.

Although the known processes for forming two-color images are suitable for their intended purposes, a need continues to exist for processes for forming two-color images. In addition, a need remains for two-color image formation processes wherein the two developers exhibit a low level of mutual interaction. Mutual interaction may occur, for example, when the carrier of the developer used second triboelectrically charges against the toner used first; thus, the first image is developed with the first developer and the second image is subsequently developed with the second developer of different color, and during development of the second image, the carrier of the second developer triboelectrically interacts with the image previously developed with the first toner. This interaction can result in removal of some of the first toner from the substrate, causing reduced image density, and can also lead to contamination of the second developer housing with the first toner. A need also exists for a process for forming two-color images wherein the second developer does not react with, or is triboactively neutral to, the first developed image on the photoreceptor. A need also exists for a process for forming two-color images wherein the first developer does not discharge the latent image to be developed by the second developer. Additionally, there is a need for a two-color image formation process wherein the developers are of specified triboelectric charge, charge distribution, and conductivity, and exhibit acceptable admix times and developer lifetimes. Further, there is a need for a two-color image formation process wherein the two developers exhibit similar rheological properties, thereby enhancing fusing, and similar cleaning latitudes, thereby enhancing cleaning of the photoreceptor.

SUMMARY OF THE INVENTION

It is an object of the present invention to provide processes for forming two-color images.

It is another object of the present invention to provide two-color image formation processes wherein the two developers exhibit a low level of mutual interaction.

It is still another object of the present invention to provide a process for forming two-color images wherein the second developer does not react with, or is triboactively neutral to, the first developed image on the photoreceptor.

It is yet another object of the present invention to provide a process for forming two-color images wherein the first developer does not discharge the latent image to be developed by the second developer.

Another object of the present invention is to provide a two-color image formation process wherein the developers are of specified triboelectric charge, charge distribution, and conductivity, and exhibit acceptable admix times and developer lifetimes.

Still another object of the present invention is to provide a two-color image formation process wherein the two developers exhibit similar rheological properties, thereby enhancing fusing, and similar cleaning latitudes, thereby enhancing cleaning of the photoreceptor.

These and other objects of the present invention are achieved by providing a process for forming two-color images which comprises (1) charging an imaging member in an imaging apparatus; (2) creating on the member a latent image comprising areas of high, intermediate, and low potential; (3) developing the low areas of potential by conductive magnetic brush development with a developer comprising a colored first toner comprising a first resin present in an amount of from about 80 to about 98.8 percent by weight and selected from the group consisting of polyesters, styrene-butadiene polymers, styrene-acrylate polymers, styrene-methacrylate polymers, and mixtures thereof; a first pigment present in an amount of from about 1 to about 15 percent by weight and selected from the group consisting of copper phthalocyanine pigments, quinacridone pigments, azo pigments, rhodamine pigments, and mixtures thereof; a charge control agent present in an amount of from about 0.2 to about 5 percent by weight; colloidal silica surface external additives present in an amount of from about 0.1 to about 2 percent by weight; and external additives comprising metal salts or metal salts of fatty acids present in an amount of from about 0.1 to about 2 percent by weight; and a first carrier comprising a steel core with an average diameter of from about 25 to about 215 microns and a coating selected from the group consisting of methyl terpolymer, polymethyl methacrylate, and a blend of from about 35 to about 65 percent by weight of polymethylmethacrylate and from about 35 to about 65 percent by weight of chlorotrifluoroethylene-vinyl chloride copolymer, wherein the coating contains from 0 to about 40 percent by weight of the coating of conductive particles and wherein the coating weight is from about 0.2 to about 3 percent by weight of the carrier; (4) subsequently developing the high areas of potential by conductive magnetic brush development with a developer comprising a black second toner comprising a second resin present in an amount of from about 80 to about 98.8 percent by weight and selected from the group consisting of polyesters, styrene-butadiene polymers, styrene-acrylate polymers, styrene-methacrylate polymers, and mixtures thereof; a second pigment present in an amount of from about 1 to about 15 percent by weight; and a second charge control additive present in an amount of from about 0.1 to about 6 percent by weight; and a second carrier comprising a steel core with an average diameter of from about 25 to about 215 microns and a coating selected from the group consisting of chlorotrifluoroethylene-vinyl chloride copolymer containing from 0 to about 40 percent by weight of conductive particles at a coating weight of from about 0.4 to about 1.5 percent by weight of the carrier; polyvinylfluoride at a coating weight of from about 0.01 to about 0.2 percent by weight of the carrier; and polyvinylchloride at a coating weight of from about 0.01 to about 0.2 percent by weight of the carrier; and (5) transferring the developed two-color image to a substrate.

Imaging members suitable for use with the process of the present invention may be of any type capable of maintaining three distinct levels of potential. Generally, various dielectric or photoconductive insulating material suitable for use in xerographic, ionographic, or other electrophotographic processes may be used, and suitable photoreceptor materials include amorphous silicon, layered organic materials as disclosed in U.S. Pat. No. 4,265,990, the disclosure of which is totally incorporated herein by reference, and the like.

The photoresponsive imaging member can be negatively charged, positively charged, or both, and the latent image formed on the surface may consist of either a positive or a negative potential, or both. In one embodiment, the image consists of three distinct levels of potential, all being of the same polarity. The levels of potential should be well differentiated, such that they are separated by at least 100 volts, and preferably 200 volts or more. For example, a latent image on an imaging member can consist of areas of potential at −800, −400, and −100 volts. In addition, the levels of potential may consist of ranges of potential. For example, a latent image may consist of a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range, with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a layered organic photoreceptor is employed, preferred potential ranges are from about −700 to about −850 volts for the high level of potential, from about −350 to about −450 volts for the intermediate level of potential, and from about −100 to about −180 volts for the low level of potential. These values will differ, depending upon the type of imaging member selected.

The latent image comprising three levels of potential, hereinafter referred to as a tri-level image, may be formed on the imaging member by any of various suitable methods, such as those disclosed in U.S. Pat. No. 4,078,929, the disclosure of which is totally incorporated herein by reference. For example, a tri-level charge pattern may be formed on the imaging member by the xerographic method of first uniformly charging the imaging member in the dark to a single polarity, followed by exposing the member to an original having areas both lighter and darker than the background area, such as a piece of gray paper having both white and black images thereon. In a preferred embodiment, a tri-level charge pattern may be formed by means of a raster output scanner, optically modulating laser light as it scans a uniformly charged photoconductive imaging member. In this embodiment, the areas of high potential are formed by turning the light source off, the areas of intermediate potential are formed by exposing the imaging member to the light source at partial power, and the areas of low potential are formed by exposing the imaging member to the light source at full power. Other electrophotographic and ionographic methods of generating latent images are also acceptable.

Generally, in the process of the present invention the highlighted areas of the image are developed with a developer having a color other than black, while the remaining portions of the image are developed with a black developer. In general, the highlighted color portions are developed first to minimize the interaction between the two developers, thereby maintaining the high quality of the black image.

Development is generally by the magnetic brush development process disclosed in U.S. Pat. No. 2,874,063, the disclosure of which is totally incorporated herein by reference. This method entails the carrying of a developer material containing toner and magnetic carrier particles by a magnet. The magnetic field of the magnet causes alignment of the magnetic carriers in a brushlike configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. For the process of the present invention, the conductive magnetic brush process is generally preferred, wherein the developer comprises conductive carrier particles and is capable of conducting an electric field between the biased magnet through the carrier particles to the photoreceptor. Conductive magnetic brush development is generally employed for the process of the present invention in view of the relatively small development potentials of around 200 volts that are generally available for the process; conductive development ensures that sufficient toner is laid on the photoreceptor under these development potentials to result in acceptable image density. Conductive development is also preferred to ensure that fringe fields occurring around the edges of images of one color are not developed by the toner of the other color.

During the development process, the developer housings are biased to a voltage between the level of potential being developed and the intermediate level of charge on the imaging member. For example, if the latent image consists of a high level of potential of about −800 volts, an intermediate level of potential of about −400 volts, and a low level of about −100 volts, the developer housing containing the positively charged toner that develops the high areas of potential may be biased to about −500 volts and the developer housing containing the negatively charged toner that develops the low areas of potential may be biased to about −300 volts. These biases result in a development potential of about −200 volts for the high areas of potential, which will be developed with a positively charged toner, and a development potential of about +200 volts for the low areas of potential, which will be developed with a negatively charged toner. Background deposits are suppressed by keeping the background intermediate voltage between the bias on the color developer housing and the bias on the black developer housing. Generally, it is preferred to bias the housing containing the positive toner to a voltage of from about 100 to about 150 volts above the intermediate level of potential and to bias the housing containing the negative toner to a voltage of from about 100 to about 150 volts below the intermediate level of potential, although these values may be outside these ranges provided that the objectives of the present invention are achieved.

The developed image is then transferred to any suitable substrate, such as paper, transparency material, and the like. Prior to transfer, it is preferred to apply a charge by means of a corotron to the developed image in order to charge both toners to the same polarity, thus enhancing transfer. Transfer may be by any suitable means, such as by charging the back of the substrate with a corotron to a polarity opposite to the polarity of the toner. The transferred image is then permanently affixed to the substrate by any suitable means. For the toners of the present invention, fusing by application of heat and pressure is preferred.

Colored developers suitable for the process of the present invention comprise a toner and a carrier. Preferred carriers are generally conductive, and generally exhibit a conductivity of, for example, from about $10^{-14}$ to about $10^{-6}$, and preferably from about $10^{-11}$ to about $10^{-7}$ (ohm-cm)$^{-1}$. Conductivity is generally controlled by the choice of carrier core and coating; by partially coating the carrier core, or by coating the core with a coating of a material containing carbon black, the carrier is rendered conductive. In addition, irregularly shaped carrier particle surfaces and toner concentrations of from about 0.2 to about 5 will generally render a developer conductive. Addition of a surface additive such as zinc stearate to the surface of the toner particles also renders a developer conductive, with the level of conductivity rising with increased concentrations of the additive. The carrier for the colored developers of the present invention generally comprises a steel core, preferably unoxidized, such as Hoeganoes Anchor Steel Grit, with an average diameter of from about 25 to about 215 microns, preferably from 50 to 150 microns. The carrier particles are coated with a solution coating of methyl terpolymer containing from 0 to about 40 percent by weight of conductive particles such as carbon black or other conductive particles as disclosed in U.S. Pat. No. 3,533,835, the disclosure of which is totally incorporated herein by reference, homogeneously dispersed in the coating material, with the coating weight being from about 0.2 to about 3 percent by weight of the carrier, and preferably from about 0.4 to about 1.5 percent by weight of the carrier. Alternatively, the carrier coating may comprise polymethylmethacrylate containing conductive particles in an amount of from 0 to about 40 percent by weight of the polymethylmethacrylate, and preferably from about 10 to about 20 percent by weight of the polymethylmethacrylate, wherein the coating weight is from about 0.2 to about 3 percent by weight of the carrier and preferably about 1 percent by weight of the carrier. A third possible carrier coating for the carrier of the colored developer comprises a blend of from about 35 to about 65 percent by weight of polymethylmethacrylate and from about 35 to about 65 percent by weight of chlorotrifluoroethylene-vinyl chloride copolymer, commercially available as OXY 461 from Occidental Petroleum Company containing conductive particles in an amount of from 0 to about 40 percent by weight, and preferably from about 20 to about 30 percent by weight, wherein the coating weight is from about 0.2 to about 3 percent by weight of the carrier, and preferably about 1 percent by weight of the carrier. Preferably, the carrier coatings are placed on the carrier cores by a solution coating process.

Colored toners suitable for development of the highlighted portions of the image generally comprise a resin or resins, one or a blend of two pigments, and a charge control agent. Suitable resins include polyesters and styrene-butadiene polymers, particularly styrene-butadiene copolymers wherein the styrene portion is present in an amount of from about 83 to about 93 percent by weight, preferably about 88 percent by weight, and the butadiene portion is present in an amount of from about 7 to about 17 percent by weight, preferably about 12 percent by weight, such as the resins commercially available as Pliolite® or Pliotone® from Goodyear. Also suitable are styrene acrylate polymers and styrene-n-butylmethacrylate polymers, particularly those styrene-n-butylmethacrylate copolymers wherein the styrene portion is present in an amount of from about 50 to about 70 percent by weight, preferably about 58 percent by weight, and the n-butylmethacrylate portion is present in an amount of from about 30 to about 50 percent by weight, preferably about 42 percent by weight. Mixtures of these resins are also suitable. Also particularly suitable for inclusion in the toners for the present invention are styrene-n-butylmethacrylate polymers wherein the styrene portion is present in an amount of from about 50 to about 80 percent by weight, preferably about 65 percent by weight, and the n-butylmethacrylate portion is present in an amount of from about 50 to about 20 percent by weight, preferably about 35 percent by weight. The resin is generally present in an amount of from about 80 to about 98.8 percent by weight.

Suitable colored toner pigments include copper phthalocyanine pigments, quinacridone pigments, azo pigments, rhodamine pigments, and mixtures thereof. Specific examples include Fanal Pink, commercially available from BASF, Sudan Blue OS, commercially available from BASF, Neopan Blue, commercially available from BASF, PV Fast Blue, commercially available from BASF, Lithol Scarlet, commercially available from BASF, Hostaperm Pink E pigment, commercially available from American Hoechst Company, Fanchon Fast Red R-6226, commercially available from Mobay Chemical Company, and Permanent Yellow FGL, commercially available from E.I. DuPont Company. Generally, the pigment is present in an amount of from about 1 to about 15 percent by weight, and preferably from about 2 to about 10 percent by weight.

Suitable charge control agents for the colored toners include alkyl pyridinium halides such as cetyl pyridinium chloride, distearyl dimethyl ammonium methyl sulfate, and aluminum salicylate. The charge control agent is generally present in an amount of from about 0.1 to about 5, and preferably from about 0.5 to about 1.5 percent by weight, although other amounts may be present provided that the objectives of the present invention are achieved. When the images formed are to be fused with rollers of Viton®, a distearyl dimethyl ammonium methyl sulfate charge control agent is preferred, since it is more compatible with Viton®. When other materials comprise the fuser roll, however, cetyl pyridinium chloride may also be used. The presence of these charge control additives generally also improve admix performance.

In addition, external additives of colloidal silica, such as Aerosil® R972, Aerosil® R976, Aerosil® R812, and the like, available from Degussa, and metal salts or metal salts of fatty acids, such as zinc stearate, magnesium stearate, aluminum stearate, cadmium stearate, and the like, are blended on the surface of the colored toners. Toners with these additives blended on the surface are disclosed in references such as U.S. Pat. Nos. 3,590,000; 3,720,617; 3,900,588 and 3,983,045, the disclosures of each of which are totally incorporated herein by reference. Generally, the silica is present in an amount of from about 0.1 to about 2 percent by weight, and preferably about 0.3 percent by weight, of the toner and the zinc stearate is present in an amount of from about 0.1 to about 2 percent by weight, and preferably about 0.3 percent by weight, of the toner. Varying the amounts of these two external additives enables adjustment of the charge levels and conductivities of the toners. For example, increasing the amount of silica generally adjusts the triboelectric charge in a negative direction and improves admix times, which are a measure of the amount of time required for fresh toner to become triboelectrically charged after coming into contact with the carrier. In addition, increasing the amount of zinc stearate improves admix times, renders the developer composition more conductive, adjusts the triboelectric charge in a positive direction, and improves humidity insensitivity.

Colored developer compositions for the present invention prepared from this toner and carrier generally comprise from about 0.5 to about 5 percent by weight of the toner and from about 95 to about 99.5 percent by weight of the carrier. The ratio of toner to carrier may vary, however, provided that the objectives of the present invention are achieved. For example, an imaging apparatus employed for the process of the present invention may be replenished with a colored developer comprising about 55 percent by weight toner and about 45 percent by weight carrier. The triboelectric charge of the colored toners generally is from about −10 to about −30, and preferably from about −15 to about −20 microcoulombs per gram, although the value may be outside of this range provided that the objectives of the present invention are achieved. Particle size of the colored toners is generally from about 7 to about 20 microns in volume average diameter, and preferably about 13 microns in volume average diameter, although the value may be outside of this range provided that the objectives of the present invention are achieved.

Black developers suitable for the process of the present invention comprise a toner and a carrier. The carrier generally comprises a steel core, such as Hoeganoes Anchor Steel Grit, with an average diameter of from about 25 to about 215 microns, preferably from about 50 to about 150 microns, with a coating of chlorotrifluoroethylene-vinyl chloride copolymer, commercially available as OXY 461 from Occidental Petroleum Company, said coating containing from 0 to about 40 percent by weight of conductive particles homogeneously dispersed in the coating, at a coating weight of from about 0.4 to about 1.5 percent by weight. This coating is generally solution coated onto the carrier core from a suitable solvent, such as methyl ethyl ketone or toluene. Alternatively, the carrier coating may comprise a coating of polyvinyl fluoride, commercially available as Tedlar® from E.I. Du Pont de Nemours and Company, present in a coating weight of from about 0.01 to about 0.2, and preferably about 0.05, percent by weight of the carrier. The polyvinyl fluoride coating is generally coated onto the core by a powder coating process, wherein the carrier core is coated with the polyvinyl fluoride in powder form and subsequently heated to fuse the coating. In one preferred embodiment, the carrier comprises an unoxidized steel core which is blended with polyvinyl fluoride (Tedlar®), wherein the polyvinyl fluoride is present in an amount of about 0.05 percent by weight of the core. This mixture is then heat treated in a kiln at about 400° F. to fuse the polyvinyl fluoride coating to the core. The resulting carrier exhibits a conductivity of about $7.6\times10^{-10}$ (ohm-cm)$^{-1}$. Optionally, an additional coating of polyvinylidene fluoride, commercially available as Kynar® from Pennwalt Corporation, may be powder coated on top of the other coating of the carrier in the black developer at a coating weight of from about 0.01 to about 0.2 percent by weight. The carrier for the black developer generally has a conductivity of from about $10^{-14}$ to about $10^{-7}$, and preferably from about $10^{-12}$ to about $10^{-9}$ (ohm-cm)$^{-1}$.

Black toners suitable for development of the image generally comprise a resin, a pigment, and a charge control additive. Suitable resins include polyesters, styrene-butadiene polymers, styrene acrylate polymers, and styrene-methacrylate polymers, and particularly styrene-n-butylmethacrylate copolymers wherein the styrene portion is present in an amount of from about 50 to about 80 percent by weight, preferably about 58 percent by weight, and the n-butylmethacrylate portion is present in an amount of from about 20 to about 50 percent by weight, preferably about 42 percent by weight. Generally, the resin is present in an amount of from about 80 to about 98.8 percent by weight, and preferably in an amount of 92 percent by weight. Suitable pigments include those such as carbon black, including as Regal® 330, commercially available from Cabot Corporation. Generally, the pigment is present in an amount of from about 1 to about 15 percent by weight, and preferably in an amount of about 6 percent by weight.

Suitable charge control agents for the black toner of the present invention include distearyl dimethyl ammonium methyl sulfate and alkyl pyridinium halides such as cetyl pyridinium chloride and the like. The charge control agent is present in an amount of from about 0.1 to about 6 percent by weight, and preferably in an amount of about 2 percent by weight. In addition, the black toner may contain magnetite, such as Mapico Black, in an amount of from about 8 to about 20, and preferably about 15 or 16 percent by weight. A toner suitable for the present invention containing magnetite generally comprises from about 71.25 to about 87.8 percent by weight of the resin, from about 8 to about 20 percent by weight of the magnetite, from about 4 to about 7 percent by weight of carbon black, and from about 0.2 to about 1.75 percent by weight of the charge control additive.

In addition, external additives of colloidal silica, such as Aerosil® R972, Aerosil®R976, Aerosil® R812, and the like, available from Degussa, and metal salts or metal salts of fatty acids, such as zinc stearate, magnesium stearate, and the like, may optionally be blended on the surface of the black toner. Generally, the silica is present in an amount of from about 0.1 to about 2 percent by weight of the toner and the zinc stearate is present in an amount of from about 0.1 to about 2 percent by weight of the toner. These additives function in the manner described for the color toners with respect to charge control, admix control, conductivity control, and the like.

The black toners of the present invention may also optionally contain as an external additive a linear polymeric alcohol comprising a fully saturated hydrocarbon backbone with at least about 80 percent of the polymeric chains terminated at one chain end with a hydroxyl group. The linear polymeric alcohol is of the general formula $CH_3(CH_2)_nCH_2OH$, wherein n is a number from about 30 to about 300, and preferably from about 30 to about 50. Linear polymeric alcohols of this type are generally available from Petrolite Chemical Company as Unilin TM. The linear polymeric alcohol is generally present in an amount of from about 0.1 to about 1 percent by weight of the toner.

Black developer compositions for the present invention generally comprise from about 1 to about 5 percent by weight of the toner and from about 95 to about 99 percent by weight of the carrier. The ratio of toner to carrier may vary, however, provided that the objectives of the present invention are achieved. For example, an imaging apparatus employed for the process of the present invention may be replenished with a colored developer comprising about 65 percent by weight toner and about 35 percent by weight carrier. The triboelectric charge of the black toners generally is from about +10 to about +30, and preferably from about +13 to about +18 microcoulombs per gram, although the value may be outside of this range provided that the objectives of the present invention are achieved. Particle size of the black toners is generally from about 8 to about 13 microns in volume average diameter, and preferably about 11 microns in volume average diameter, although the value may be outside of this range provided that the objectives of the present invention are achieved.

Coating of the carrier particles of the present invention may be by any suitable process, such as powder coating, wherein a dry powder of the coating material is applied to the surface of the carrier particle and fused to the core by means of heat, solution coating, wherein the coating material is dissolved in a solvent and the resulting solution is applied to the carrier surface by tumbling, or fluid bed coating, in which the carrier particles are blown into the air by means of an air stream, and an atomized solution comprising the coating material and a solvent is sprayed onto the airborne carrier particles repeatedly until the desired coating weight is achieved.

The toners of the present invention may be prepared by processes such as extrusion, which is a continuous process that entails dry blending the resin, pigment, and charge control additive, placing them into an extruder, melting and mixing the mixture, extruding the material, and reducing the extruded material to pellet form. The pellets are further reduced in size by grinding or jetting, and are then classified by particle size. External additives such as linear polymeric alcohols, silica, or zinc stearate are then blended with the classified toner in a powder blender. Subsequent admixing of the toners with the carriers, generally in amounts of from about 0.5 to about 5 percent by weight of the toner and from about 95 to about 99.5 percent by weight of the carrier, yields the developers of the present invention.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

A black developer composition was prepared as follows. 92 parts by weight of a styrene-n-butylmethacrylate resin, 6 parts by weight of Regal 330® carbon black from Cabot Corporation, and 2 parts by weight of cetyl pyridinium chloride were melt blended in an extruder wherein the die was maintained at a temperature of between 130° and 145° C. and the barrel temperature ranged from about 80° to about 100° C., followed by micronization and air classification to yield toner particles of a size of 12 microns in volume average diameter. Subsequently, carrier particles were prepared by solution coating a Hoeganoes Anchor Steel core with a particle diameter range of from about 75 to about 150 microns, available from Hoeganoes Company, with 0.4 parts by weight of a coating comprising 20 parts by weight of Vulcan carbon black, available from Cabot Corporation, homogeneously dispersed in 80 parts by weight of a chlorotrifluoroethylene-vinyl chloride copolymer, commercially available as OXY 461 from Occidental Petroleum Company, which coating was solution coated from a methyl ethyl ketone solvent. The black developer was then prepared by blending 97.5 parts by weight of the coated carrier particles with 2.5 parts by weight of the toner in a Lodige Blender for about 10 minutes, resulting in a developer with a toner exhibiting a triboelectric charge of +18.6 microcoulombs per gram and a carrier conductivity of $6.6\times10^{-10}$ (ohm-cm)$^{-1}$. Admix time for the toner was less than 30 seconds.

EXAMPLE II

A red developer composition was prepared as follows. 85 parts by weight of styrene butadiene, 1 part by weight of distearyl dimethyl ammonium methyl sulfate, available from Hexcel Corporation, 13.44 parts by weight of a 1:1 blend of styrene-n-butylmethacrylate and Lithol Scarlet NB3755 from BASF, and 0.56 parts by weight of Hostaperm Pink E from Hoechst Corporation were melt blended in an extruder wherein the die was maintained at a temperature of between 130° and 145° C. and the barrel temperature ranged from about 80° to about 100° C., followed by micronization and air classification to yield toner particles of a size of 11.5 microns in volume average diameter. The toner particles were then blended with 0.3 parts by weight of Aerosil ® R972 and 0.3 parts by weight of zinc stearate onto the surface of the toner in a Lodige blender. Subsequently, carrier particles were prepared by solution coating a Hoeganoes Anchor Steel core with a particle diameter range of from about 75 to about 150 microns, available from Hoeganoes Company, with 1 part by weight of a coating comprising 20 parts by weight of Vulcan carbon black, available from Cabot Corporation, homogeneously dispersed in 80 parts by weight of polymethylmethacrylate, which coating was solution coated from a toluene solvent. The red developer was then prepared by blending 97.5 parts by weight of the coated carrier particles with 2.5 parts by weight of the toner in a Lodige Blender for about 10 minutes, resulting in a developer with a toner exhibiting a triboelectric charge of −19.7 microcoulombs per gram and a carrier conductivity of $1.5\times10^{-10}$ (ohm-cm)$^{-1}$. Admix time for the toner was less than 30 seconds.

The red developer thus prepared and the black developer prepared in Example I were then incorporated into an imaging device equipped to generate and develop tri-level images according to the method of U.S. Pat. No. 4,078,929, the disclosure of which is totally incorporated herein by reference. A tri-level latent image was formed on the imaging member and the low areas of −100 volts potential were developed with the red developer, followed by development of the high areas of −750 volts potential with the black developer, subsequent transfer of the two-color image to paper, and heat fusing of the image to the paper. Images thus formed exhibited excellent copy quality with very low background for 400,000 imaging cycles, at which time the test was terminated.

EXAMPLE III

A red developer composition was prepared as follows. 92 parts by weight of styrene butadiene, 1 part by weight of distearyl dimethyl ammonium methyl sulfate, available from Hexcel Corporation, 6.44 parts by weight of Lithol Scarlet NB 3755 from BASF, and 0.56 parts by weight of Hostaperm Pink E from Hoechst Corporation were melt blended in an extruder wherein the die was maintained at a temperature of between 130° and 145° C. and the barrel temperature ranged from about 80° to about 100° C., followed by micronization and air classification to yield toner particles of a size of 11.5 microns in volume average diameter. The toner particles were then blended with 0.3 parts by weight of Aerosil ® R972 and 0.3 parts by weight of zinc stearate onto the surface of the toner in a Lodige blender. Subsequently, carrier particles were prepared by solution coating a Hoeganoes Anchor Steel core with a particle diameter range of from about 75 to about 150 microns, available from Hoeganoes Company, with 1 part by weight of a coating comprising 20 parts by weight of Vulcan carbon black, available from Cabot Corporation, homogeneously dispersed in 80 parts by weight of polymethylmethacrylate, wherein the coating was solution coated from a toluene solvent. The red developer was then prepared by blending 97.5 parts by weight of the coated carrier particles with 2.5 parts by weight of the toner in a Lodige Blender for about 10 minutes, resulting in a developer with a toner exhibiting a triboelectric charge of −17 microcoulombs per gram and a carrier conductivity of $9.8\times10^{-10}$ (ohm-cm)$^{-1}$. Admix time for the toner was less than 30 seconds.

The red developer thus prepared and the black developer prepared in Example I were then incorporated into an imaging device equipped to generate and develop tri-level images according to the method of U.S. Pat. No. 4,078,929. A tri-level latent image was formed on the imaging member and the low areas of −100 volts potential were developed with the red developer, followed by development of the high areas of −750 volts potential with the black developer, subsequent transfer of the two-color image to paper, and heat fusing of the image to the paper. Images thus formed exhibited excellent copy quality with very low background for 400,000 imaging cycles, at which time the test was terminated.

EXAMPLE IV

A blue developer was prepared as follows. 92 parts by weight of styrene butadiene, 1 part by weight of distearyl dimethyl ammonium methyl sulfate, available from Hexcel Corporation, and 7 parts by weight of PV Fast Blue from BASF were melt blended in an extruder wherein the die was maintained at a temperature of between 130° and 145° C. and the barrel temperature ranged from about 80° to about 100° C., followed by micronization and air classification to yield toner particles of a size of 12 microns in volume average diameter. The toner particles were then blended with 0.3 parts by weight of Aerosil ® R972 and 0.3 parts by weight of zinc stearate onto the surface of the toner in a Lodige blender. Subsequently, carrier particles were prepared by solution coating a Hoeganoes Anchor Steel core with a particle diameter range of from about 75 to about 150 microns, available from Hoeganoes Company, with 1 part by weight of a coating comprising 20 parts by weight of Vulcan carbon black, available from Cabot Corporation, homogeneously dispersed in 80 parts by weight of polymethylmethacrylate, which coating was solution coated from a toluene solvent. The blue developer was then prepared by blending 97.5 parts by weight of the coated carrier particles with 2.5 parts by weight of the toner in a Lodige Blender for about 10 minutes, resulting in a developer with a toner exhibiting a triboelectric charge of −15.6 microcoulombs per gram and a carrier conductivity of $3.3\times10^{-6}$ (ohm-cm)$^{-1}$. Admix time for the toner was less than 30 seconds.

The blue developer thus prepared and the black developer prepared in Example I were then incorporated into an imaging device equipped to generate and develop tri-level images according to the method of U.S. Pat. No. 4,078,929. A tri-level latent image was formed on the imaging member and the low areas of −100 volts potential were developed with the blue developer, followed by development of the high areas of −750 volts potential with the black developer, subsequent transfer of the two-color image to paper, and heat fusing of the image to the paper. Images thus formed exhibited excellent copy quality with very low background for 400,000 imaging cycles, at which time the test was terminated.

EXAMPLE V

A blue developer was prepared as follows. 89.5 parts by weight of styrene butadiene, 0.5 part by weight of distearyl dimethyl ammonium methyl sulfate, available from Hexcel Corporation, 1 part by weight of Hostaperm Pink E, and 9 parts by weight of Sudan Blue from BASF were melt blended in an extruder wherein the die was maintained at a temperature of between 130° and 145° C. and the barrel temperature ranged from about 80° to about 100° C., followed by micronization and air classification to yield toner particles of a size of 12 microns in volume average diameter. The toner particles were then blended with 0.3 parts by weight of Aerosil ® R972 and 0.3 parts by weight of zinc stearate onto the surface of the toner in a Lodige blender. Subsequently, carrier particles were prepared by solution coating a Hoeganoes Anchor Steel core with a particle diameter range of from about 75 to about 150 microns, available from Hoeganoes Company, with 1 part by weight of a coating comprising 20 parts by weight of Vulcan carbon black, available from Cabot Corporation, homogeneously dispersed in 80 parts by weight of polymethylmethacrylate, which coating was solution coated from a toluene solvent. The blue developer was then prepared by blending 97.5 parts by weight of the coated carrier particles with 2.5 parts by weight of the toner in a Lodige Blender for about 10 minutes, resulting in a developer with a toner exhibiting a triboelectric charge of −14 microcoulombs per gram and a carrier conductivity of $9\times10^{-6}$ (ohm-cm)$^{-1}$. Admix time for the toner was less than 30 seconds.

The blue developer thus prepared and the black developer prepared in Example I were then incorporated into an imaging device equipped to generate and develop tri-level images according to the method of U.S. Pat. No. 4,078,929. A tri-level latent image was formed on the imaging member and the low areas of −100 volts potential were developed with the blue developer, followed by development of the high areas of −750 volts potential with the black developer, subsequent transfer of the two-color image to paper, and heat fusing of the image to the paper. Images thus formed exhibited excellent copy quality with very low background for 400,000 imaging cycles at which time the test was terminated.

EXAMPLE VI

A green developer was prepared as follows. 89.5 parts by weight of styrene butadiene, 0.5 part by weight of distearyl dimethyl ammonium methyl sulfate, available from Hexcel Corporation, 5 parts by weight of Sudan Blue from BASF, and 5 parts by weight of Permanent FGL Yellow from E. I. Du Pont de Nemours and Company were melt blended in an extruder wherein the die was maintained at a temperature of between 130° and 145° C. and the barrel temperature ranged from about 80° to about 100° C., followed by micronization and air classification to yield toner particles of a size of 12.5 microns in volume average diameter. The toner particles were then blended with 0.3 part by weight of Aerosil ® R972 and 0.3 parts by weight of zinc stearate onto the surface of the toner in a Lodige blender. Subsequently, carrier particles were prepared by solution coating a Hoeganoes Anchor Steel core with a particle diameter range of from about 75 to about 150 microns, available from Hoeganoes Company, with 1 part by weight of a coating comprising 20 parts by weight of Vulcan carbon black, available from Cabot Corporation, homogeneously dispersed in 80 parts by weight of polymethylmethacrylate, which coating was solution coated from a toluene solvent. The green developer was then prepared by blending 97.5 parts by weight of the coated carrier particles with 2.5 parts by weight of the toner in a Lodige Blender for about 10 minutes, resulting in a developer with a toner exhibiting a triboelectric charge of −16 microcoulombs per gram and a carrier conductivity of $6\times10^{-6}$ (ohm-cm)$^{-1}$. Admix time for the toner was less than 30 seconds.

The green developer thus prepared and the black developer prepared in Example I were then incorporated into an imaging device equipped to generate and develop tri-level images according to the method of U.S. Pat. No. 4,078,929. A tri-level latent image was formed on the imaging member and the low areas of −100 volts potential were developed with the green developer, followed by development of the high areas of −750 volts potential with the black developer, subsequent transfer of the two-color image to paper, and heat fusing of the image to the paper. Images thus formed exhibited excellent copy quality with very low background for 400,000 imaging cycles, at which time the test was terminated.

COMPARATIVE EXAMPLE A

The process of Example II was repeated with the exception that the coating on the carrier in the black developer was polyvinylidene fluoride, commercially available as Kynar ®, present in a coating weight of 0.17 percent by weight. The red and black developers were then placed into an imaging device equipped to generate and develop tri-level images according to the method of U.S. Pat. No. 4,078,929. A tri-level latent image was formed on the imaging member and the low areas of −100 volts potential were developed with the red developer, followed by development of the high areas of −750 volts potential with the black developer, subsequent transfer of the two-color image to paper, and heat fusing of the image to the paper. Images thus formed were of poor quality in that the optical density of the red areas was undesirably light. It is believed that the carrier in the black developer, which carrier was coated with polyvinylidene fluoride, contacted the previously formed red image on the photoreceptor, charged against the red toner, and removed red toner from the red image, thereby impairing image quality. After several imaging cycles, the red toner that had been carried into the black developer housing by the polyvinylidene fluoride coated carrier impaired the triboelectric characteristics of the black toner and resulted in black areas of the image being developed with red toner.

COMPARATIVE EXAMPLE B

The process of Comparative Example A was repeated except that the colored developer was the one prepared in Example VI. The green and black developers were then placed into an imaging device equipped to generate and develop tri-level images according to the method of U.S. Pat. No. 4,078,929. A tri-level latent image was formed on the imaging member and the low areas of −100 volts potential were developed with the green developer, followed by development of the high areas of −750 volts potential with the black developer, subsequent transfer of the two-color image to paper, and heat fusing of the image to the paper. Images thus formed were of poor quality in that the optical density of the green areas was undesirably light. It is believed that the carrier in the black developer, which carrier was coated with polyvinylidene fluoride, contacted the previously formed green image on the photoreceptor, charged against the green toner, and removed green toner from the green image, thereby impairing image quality. After several imaging cycles, the green toner that had been carried into the black developer housing by the polyvinylidene fluoride coated carrier impaired the triboelectric characteristics of the black toner and resulted in black areas of the image being developed with green toner.

COMPARATIVE EXAMPLE C

The procedure of Example II was repeated except that the red toner was not blended with a zinc stearate external additive. Blending the toner with the carrier resulted in a developer with a toner exhibiting a triboelectric charge of −25 microcoulombs per gram and a carrier conductivity of about $3.3\times10^{-14}$. Admix time of the toner was about 2 minutes. The red and black developers were then placed into an imaging device equipped to generate and develop tri-level images according to the method of U.S. Pat. No. 4,078,929. A tri-level latent image was formed on the imaging member and the low areas of −100 volts potential were developed with the red developer, followed by development of the high areas of −750 volts potential with the black developer, subsequent transfer of the two-color image to paper, and heat fusing of the image to the paper. Images thus formed were of poor quality in that the optical density of the red areas was extremely light. In addition, solid red image areas exhibited poor image density in the central portions, and black outlines were observed around the red images in some instances. It is believed that the absence of zinc stearate on the red toner particles rendered the red developer insufficiently conductive for satisfactory development of images.

COMPARATIVE EXAMPLE D

The procedure of Example V was repeated except that the blue toner was not blended with a zinc stearate external additive. Blending the toner with the carrier resulted in a developer with a toner exhibiting a triboelectric charge of −25 microcoulombs per gram and a carrier conductivity of about $3.3\times10^{-14}$. Admix time of the toner was about 2 minutes. The blue and black developers were then placed into an imaging device equipped to generate and develop tri-level images according to the method of U.S. Pat. No. 4,078,929. A tri-level latent image was formed on the imaging member and the low areas of −100 volts potential were developed with the blue developer, followed by development of the high areas of −750 volts potential with the black developer, subsequent transfer of the two-color image to paper, and heat fusing of the image to the paper. Images thus formed were of poor quality in that the optical density of the blue areas was extremely light. In addition, solid blue image areas exhibited poor image density in the central portions, and black outlines were observed around the blue images in some instances. It is believed that the absence of zinc stearate on the blue toner particles rendered the blue developer insufficiently conductive for satisfactory development of images.

COMPARATIVE EXAMPLE E

The procedure of Example II was repeated except that the red toner was not blended with either a zinc stearate external additive or a colloidal silica (Aerosil®) external additive. Blending the toner with the carrier resulted in a developer with a toner exhibiting a triboelectric charge of −10 microcoulombs per gram and a carrier conductivity of about $3.3\times10^{-14}$. Admix time of the toner was about 5 minutes. The red and black developers were then placed into an imaging device equipped to generate and develop tri-level images according to the method of U.S. Pat. No. 4,078,929. A tri-level latent image was formed on the imaging member and the low areas of −100 volts potential were developed with the red developer, followed by development of the high areas of −750 volts potential with the black developer, subsequent transfer of the two-color image to paper, and heat fusing of the image to the paper. Images thus formed were of poor quality in that the optical density of the red areas was extremely light. In addition, solid red image areas exhibited poor image density in the central portions, and black outlines were observed around the red images in some instances. It is believed that the absence of zinc stearate on the red toner particles rendered the red developer insufficiently conductive for satisfactory development of images. Further, it is believed that the absence of the colloidal silica resulted in an undesirably low triboelectric charge of −10 microcoulombs per gram and an undesirably high admix time of 5 minutes.

Other embodiments and modifications of the present invention may occur to those skilled in the art subsequent to a review of the information presented herein; these embodiments and modifications, as well as equivalents thereof, are also included within the scope of this invention.

We claim:

1. A process for forming two-colored images which comprises (1) charging an imaging member in an imaging apparatus; (2) creating on the member a latent image comprising areas of high, intermediate, and low potential; (3) developing the low areas of potential by conductive magnetic brush development with a developer comprising a colored first toner comprising a first resin present in an amount of from about 80 to about 98.8 percent by weight and selected from the group consisting of polyesters, styrene-butadiene polymers, styrene-acrylate polymers, styrene-methacrylate polymers, and mixtures thereof; a first pigment present in an amount of from about 1 to about 15 percent by weight and selected from the group consisting of copper phthalocyanine pigments, quinacridone pigments, azo pigments, rhodamine pigments, and mixtures thereof; a charge control agent present in an amount of from about 0.2 to about 5 percent by weight; colloidal silica surface external additives present in an amount of from about 0.1 to about 2 percent by weight; and external additives comprising metal salts or metal salts of fatty acids present in an amount of from about 0.1 to about 2 percent by weight;

and a first carrier comprising a steel core with an average diameter of from about 25 to about 215 microns and a coating selected from the group consisting of methyl terpolymer, polymethyl methacrylate, and a blend of from about 35 to about 65 percent by weight of polymethylmethacrylate and from about 35 to about 65 percent by weight of chlorotrifluoroethylene-vinyl chloride copolymer, wherein the coating contains from 0 to about 40 percent by weight of the coating of conductive particles and wherein the coating weight is from about 0.2 to about 3 percent by weight of the carrier; (4) subsequently developing the high areas of potential by conductive magnetic brush development with a developer comprising a black second toner comprising a second resin present in an amount of from about 80 to about 98.8 percent by weight and selected from the group consisting of polyesters, styrene-butadiene polymers, styrene-acrylate polymers, styrene-methacrylate polymers, and mixtures thereof; a second pigment, present in an amount of from about 1 to about 15 percent by weight; and a second charge control additive present in an amount of from about 0.1 to about 6 percent by weight; and a second carrier comprising a steel core with an average diameter of from about 25 to about 215 microns and a coating selected from the group consisting of chlorotrifluoroethylene-vinyl chloride copolymer containing from 0 to about 40 percent by weight of conductive particles at a coating weight of from about 0.4 to about 1.5 percent by weight of the carrier; polyvinylfluoride at a coating weight of from about 0.01 to about 0.2 percent by weight of the carrier; and polyvinylchloride at a coating weight of from about 0.01 to about 0.2 percent by weight of the carrier; and (5) transferring the developed two-color image to a substrate.

2. A process according to claim 1 wherein the imaging member is a layered organic photoreceptor.

3. A process according to claim 1 wherein the high level of potential is from about −750 to about −850 volts, the intermediate level of potential is from about −350 to about −450 volts, and the low level of potential is from about −100 to about −180 volts.

4. A process according to claim 1 wherein the levels of potential are separated by from about 100 to about 350 volts.

5. A process according to claim 1 wherein the first carrier has a conductivity of from about $10^{-14}$ to about $10^{-7}$ (ohm-cm)$^{-1}$.

6. A process according to claim 1 wherein the second carrier has a conductivity of from about $10^{-14}$ to about $10^{-7}$ (ohm-cm)$^{-1}$.

7. A process according to claim 1 wherein the colored developer is contained in a housing biased to from about −450 to about −550 volts.

8. A process according to claim 1 wherein the black developer is contained in a housing biased to from about −250 to about −350 volts.

9. A process according to claim 1 wherein the toner particles on the developed image are charged to a single polarity prior to transfer.

10. A process according to claim 1 wherein the transferred image is permanently affixed to the substrate by the application of heat and pressure.

11. A process according to claim 1 wherein the first carrier has an average diameter of from about 50 to about 150 microns.

12. A process according to claim 1 wherein the first carrier core comprises unoxidized steel.

13. A process according to claim 1 wherein the first carrier contains a coating obtained by a solution coating process.

14. A process according to claim 1 wherein the first carrier comprises a coating of methyl terpolymer containing from 0 to about 40 percent by weight of carbon black at a coating weight of from about 0.4 to about 1.5 percent by weight of the carrier.

15. A process according to claim 1 wherein the first carrier comprises a coating of a mixture of polymethylmethacrylate, present in an amount of from about 80 to about 90 percent by weight, and carbon black, present in an amount of from about 10 to about 20 percent by weight, at a coating weight of about 1 percent by weight of the carrier.

16. A process according to claim 1 wherein the first carrier comprises a coating which comprises from about 20 to about 30 percent by weight carbon black and from about 70 to about 80 percent by weight of a blend comprising from about 35 to about 65 percent by weight of polymethylmethacrylate and from about 35 to about 65 percent by weight of chlorotrifluoroethylene-vinyl chloride copolymer at a coating weight of about 1 percent by weight.

17. A process according to claim 1 wherein the colored first toner comprises a first resin selected from the group consisting of styrene-butadiene copolymers, styrene-n-butylmethacrylate copolymers, and mixtures thereof.

18. A process according to claim 1 wherein the colored first toner comprises a styrene-butadiene copolymer wherein the styrene portion is present in an amount of from about 83 to about 93 percent by weight and the butadiene portion is present in an amount of from about 7 to about 17 percent by weight.

19. A process according to claim 1 wherein the colored first toner comprises a styrene-n-butylmethacrylate copolymer wherein the styrene portion is present in an amount of from about 50 to about 70 percent by weight and the n-butylmethacrylate portion is present in an amount of from about 30 to about 50 percent by weight.

20. A process according to claim 1 wherein the colored first toner comprises a mixture of a styrene-butadiene copolymer wherein the styrene portion is present in an amount of from about 83 to about 93 percent by weight and the butadiene portion is present in an amount of from about 7 to about 17 percent by weight and a styrene-n-butylmethacrylate copolymer wherein the styrene portion is present in an amount of from about 50 to about 70 percent by weight and the n-butylmethacrylate portion is present in an amount of from about 30 to about 50 percent by weight.

21. A process according to claim 1 wherein the colored first toner comprises a styrene-n-butylmethacrylate polymer wherein the styrene portion is present in an amount of about 65 percent by weight and the n-butylmethacrylate portion is present in an amount of about 35 percent by weight.

22. A process according to claim 1 wherein the colored first toner comprises a pigment selected from the group consisting of Sudan Blue OS, Neopan Blue, PV Fast Blue, Lithol Scarlet, Hostaperm Pink E, Fanchon Fast Red R-6226, Permanent Yellow FGL, Fanal Pink, and mixtures thereof.

23. A process according to claim 1 wherein the colored first toner comprises a cetyl pyridinium chloride charge control agent.

24. A process according to claim 1 wherein the colored first toner comprises a distearyl dimethyl ammonium methyl sulfate charge control agent.

25. A process according to claim 1 wherein the triboelectric charge on the colored first toner is from about −10 to about −20 microcoulombs per gram.

26. A process according to claim 1 wherein the colored first toner has an average particle diameter of from about 11 to about 15 microns.

27. A process according to claim 1 wherein the colored first toner comprises about 85 parts by weight of a styrene butadiene resin, about 1 part by weight of distearyl dimethyl ammonium methyl sulfate, about 13.44 parts by weight of a 1:1 blend of styrene-n-butylmethacrylate and Lithol Scarlet, and about 0.56 part by weight of Hostaperm Pink E, upon the surface of which is blended about 0.3 part by weight of the toner of a colloidal silica external surface additive and about 0.3 part by weight of the toner of a zinc stearate external additive.

28. A process according to claim 1 wherein the colored first toner comprises about 92 parts by weight of a styrene butadiene resin, about 1 part by weight of distearyl dimethyl ammonium methyl sulfate, about 6.44 parts by weight of Lithol Scarlet, and about 0.56 part by weight of Hostaperm Pink E, upon the surface of which is blended about 0.3 part by weight of the toner of a colloidal silica external surface additive and about 0.3 part by weight of the toner of a zinc stearate external additive.

29. A process according to claim 1 wherein the colored first toner comprises about 92 parts by weight of a styrene butadiene resin, about 1 part by weight of distearyl dimethyl ammonium methyl sulfate, and about 7 parts by weight of PV Fast Blue, upon the surface of which is blended about 0.3 part by weight of the toner of a colloidal silica external surface additive and about 0.3 part by weight of the toner of a zinc stearate external additive.

30. A process according to claim 1 wherein the colored first toner comprises about 89.5 parts by weight of a styrene butadiene resin, about 0.5 part by weight of distearyl dimethyl ammonium methyl sulfate, about 1 part by weight of Hostaperm Pink E, and about 9 parts by weight of Sudan Blue, upon the surface of which is blended about 0.3 part by weight of the toner of a colloidal silica external surface additive and about 0.3 part by weight of the toner of a zinc stearate external additive.

31. A process according to claim 1 wherein the colored first toner comprises about 89.5 parts by weight of a styrene butadiene resin, about 0.5 part by weight of distearyl dimethyl ammonium methyl sulfate, about 5 parts by weight of Sudan Blue, and about 5 parts by weight of Permanent FGL Yellow, upon the surface of which is blended about 0.3 part by weight of the toner of a colloidal silica external surface additive and about 0.3 part by weight of the toner of a zinc stearate external additive.

32. A process according to claim 1 wherein the colored developer comprises about 2.5 parts by weight of a red toner comprising about 85 parts by weight of a styrene butadiene resin, about 1 part by weight of distearyl dimethyl ammonium methyl sulfate, about 13.44 parts by weight of a 1:1 blend of styrene-n-butylmethacrylate and Lithol Scarlet, and about 0.56 part by weight of Hostaperm Pink E, upon the surface of which is blended about 0.3 part by weight of the toner of a colloidal silica external surface additive and about 0.3 part by weight of the toner of a zinc stearate external additive, and about 97.5 parts by weight of a carrier comprising a steel core containing a coating in an amount of about 1 part by weight of the carrier comprising about 20 parts by weight of the coating of carbon black and 80 parts by weight of the coating of polymethylmethacrylate.

33. A process according to claim 1 wherein the colored developer comprises about 2.5 parts by weight of a red toner comprising about 92 parts by weight of a styrene butadiene resin, about 1 part by weight of distearyl dimethyl ammonium methyl sulfate, about 6.44 parts by weight of Lithol Scarlet, and about 0.56 part by weight of Hostaperm Pink E, upon the surface of which is blended about 0.3 part by weight of the toner of a colloidal silica external surface additive and about 0.3 part by weight of the toner of a zinc stearate external additive, and about 97.5 parts by weight of a carrier comprising a steel core containing a coating in an amount of about 1 part by weight of the carrier comprising about 20 parts by weight of the coating of carbon black and 80 parts by weight of the coating of polymethylmethacrylate.

34. A process according to claim 1 wherein the colored developer comprises about 2.5 parts by weight of a blue toner comprising about 85 parts by weight of a styrene butadiene resin, about 1 part by weight of distearyl dimethyl ammonium methyl sulfate, and about 7 parts by weight of PV Fast Blue, upon the surface of which is blended about 0.3 part by weight of the toner of a colloidal silica external surface additive and about 0.3 part by weight of the toner of a zinc stearate external additive, and about 97.5 parts by weight of a carrier comprising a steel core containing a coating in an amount of about 1 part by weight of the carrier comprising about 20 parts by weight of the coating of carbon black and 80 parts by weight of the coating of polymethylmethacrylate.

35. A process according to claim 1 wherein the colored developer comprises about 2.5 parts by weight of a blue toner comprising about 89.5 parts by weight of a styrene butadiene resin, about 0.5 part by weight of distearyl dimethyl ammonium methyl sulfate, about 1 part by weight of Hostaperm Pink E, and about 9 parts by weight of Sudan Blue, upon the surface of which is blended about 0.3 part by weight of the toner of a colloidal silica external surface additive and about 0.3 part by weight of the toner of a zinc stearate external additive, and about 97.5 parts by weight of a carrier comprising a steel core containing a coating in an amount of about 1 part by weight of the carrier comprising about 20 parts by weight of the coating of carbon black and 80 parts by weight of the coating of polymethylmethacrylate.

36. A process according to claim 1 wherein the colored developer comprises about 2.5 parts by weight of a green toner comprising about 89.5 parts by weight of a styrene butadiene resin, about 0.5 part by weight of distearyl dimethyl ammonium methyl sulfate, about 5 parts by weight of Sudan Blue, and about 5 parts by weight of Permanent FGL Yellow, upon the surface of which is blended about 0.3 part by weight of the toner of a colloidal silica external surface additive and about 0.3 part by weight of the toner of a zinc stearate external additive, and about 97.5 parts by weight of a carrier comprising a steel core containing a coating in an amount of about 1 part by weight of the carrier comprising about 20 parts by weight of the coating of carbon black and 80 parts by weight of the coating of polymethylmethacrylate.

37. A process according to claim 1 wherein the second carrier has an average diameter of from about 50 to about 150 microns.

38. A process according to claim 1 wherein the second carrier comprises an unoxidized steel core.

39. A process according to claim 1 wherein the second carrier comprises an oxidized steel core.

40. A process according to claim 1 wherein the second carrier comprises a coating comprising from about 60 to 100 percent of chlorotrifluoroethylene-vinyl chloride copolymer and from 0 to about 40 percent by weight of carbon black at a coating weight of from about 0.4 to about 1.5 percent by weight of the carrier.

41. A process according to claim 40 wherein the second carrier is coated by a solution coating process.

42. A process according to claim 1 wherein the second carrier comprises a coating of polyvinyl fluoride at a coating weight of about 0.05 percent by weight of the carrier.

43. A process according to claim 42 wherein the second carrier is coated by a powder coating process.

44. A process according to claim 1 wherein the second carrier possesses a second coating on top of the first coating comprising polyvinylidene fluoride at a coating weight of from about 0.01 to about 0.2 percent by weight of the carrier.

45. A process according to claim 1 wherein the second carrier comprises an unoxidized steel core coated with polyvinylfluoride at a coating weight of about 0.05 percent by weight of the core, wherein the carrier has a conductivity of about $7.6\times10^{-10}$ (ohm-cm)$^{-1}$.

46. A process according to claim 1 wherein the black second toner contains external additives comprising metal salts or metal salts of fatty acids present in an amount of from about 0.1 to about 2 percent by weight of the toner.

47. A process according to claim 1 wherein the black second toner contains colloidal silica present in an amount of from about 0.1 to about 2 percent by weight of the toner, wherein the silica is present on the surface of the toner.

48. A process according to claim 1 wherein the black second toner contains a colloidal silica surface external additive in an amount of from about 0.1 to about 2 percent by weight of the toner and external additives comprising metal salts or metal salts of fatty acids present in an amount of from about 0.1 to about 2 percent by weight of the toner.

49. A process according to claim 1 wherein the black second toner comprises a second resin which is a styrene-n-butylmethacrylate copolymer.

50. A process according to claim 1 wherein the black second toner comprises a cetyl pyridinium chloride charge control agent.

51. A process according to claim 1 wherein the black second toner comprises a distearyl dimethyl ammonium methyl sulfate charge control agent.

52. A process according to claim 1 wherein the black second toner comprises from about 71.25 to about 87.8 percent by weight of the second resin, from about 8 to about 20 percent by weight of magnetite, from about 4 to about 7 percent by weight of carbon black, and from about 0.2 to about 1.75 percent by weight of a charge control agent.

53. A process according to claim 1 wherein the black second toner contains a linear polymeric alcohol of the formula $CH_3(CH_2)_nCH_2OH$ wherein n is a number from about 30 to about 300.

54. A process according to claim 53 wherein the linear polymeric alcohol is present in an amount of from about 1 to about 10 percent.

55. A process according to claim 1 wherein the triboelectric charge on the black second toner is from about +10 to about +25 microcoulombs per gram.

56. A process according to claim 1 wherein the black second toner has an average particle diameter of from about 10 to about 15 microns.

57. A process according to claim 1 wherein the black second toner comprises about 92 parts by weight of a styrene-n-butylmethacrylate resin, about 6 parts by weight of carbon black, and about 2 parts by weight of cetyl pyridinium chloride.

58. A process according to claim 1 wherein the black developer comprises about 2.5 parts by weight of a black toner comprising about 92 parts by weight of a styrene-n-butylmethacrylate resin, about 6 parts by weight of carbon black, and about 2 parts by weight of cetyl pyridinium chloride, and about 97.5 parts by weight of a carrier comprising a steel core containing a coating in an amount of about 0.4 part by weight of the carrier comprising about 20 parts by weight of the coating of carbon black and 80 parts by weight of the coating of a chlorotrifluoroethylene-vinyl chloride copolymer.

59. A process for forming two-color images which comprises:

(1) charging an imaging member;

(2) creating on the member a latent image comprising areas of high, medium, and low potential;

(3) developing the low areas of potential with a colored developer which comprises:

(a) a colored first toner comprising (i) a first resin present in an amount of from about 80 to about 98.8 percent by weight and selected from the group consisting of styrene-butadiene copolymers wherein the styrene portion is present in an amount of from about 83 to about 93 percent by weight and the butadiene portion is present in an amount of from about 7 to about 17 percent by weight, styrene-n-butylmethacrylate copolymers wherein the styrene portion is present in an amount of from about 50 to about 70 percent by weight and the n-butylmethacrylate portion is present in an amount of from about 30 to about 50 percent by weight, and mixtures thereof;

(ii) a first pigment present in an amount of from about 1 to about 15 percent by weight and selected from the group consisting of Sudan Blue OS, Neopan Blue, PV Fast Blue, Lithol Scarlet, Hostaperm Pink E, Fanchon Fast Red R-6226, Permanent Yellow FGL, and mixtures thereof;

(iii) a first charge control agent present in an amount of from about 0.2 to about 5 percent by weight and selected from the group consisting of distearyl dimethyl ammonium methyl sulfate and cetyl pyridinium chloride;

(iv) colloidal silica present in an amount of from about 0.1 to about 2 percent by weight of the toner, wherein the silica is present on the surface of the toner; and (v) zinc stearate present in an amount of from about 0.1 to about 2 percent by weight of the toner, wherein the zinc stearate is present on the surface of the toner; and (b) a first carrier comprising:

(i) a steel core with an average diameter of from about 25 to about 215 microns; and (ii) a coating selected from the group consisting of methyl terpolymer containing from 0 to about 40 percent by weight of carbon black at a coating weight of from about 0.2 to about 3 percent by weight of the carrier; a mixture of polymethylmethacrylate, present in an amount of from about 80 to about 90 percent by weight, and carbon black, present in an amount of from about 10 to about 20 percent by weight, at a coating weight of from about 0.2 to about 3 percent by weight of the carrier; and a mixture of carbon black, present in an amount of from about 20 to about 30 percent by weight, and a blend of from about 35 to about 65 percent by weight of polymethylmethacrylate and from about 35 to about 65 percent by weight of chlorotrifluoroethylene-vinyl chloride copolymer, at a coating weight of from about 0.2 to about 3 percent by weight of the carrier;

(4) subsequently developing the high areas of potential with a black developer which comprises:

(a) a black second toner comprising:

(i) a second resin present in an amount of from about 80 to about 98.8 percent by weight and comprising a styrene-n-butylmethacrylate copolymer wherein the styrene portion is present in an amount of from about 50 to about 70 percent by weight and the n-butylmethacrylate portion is present in an amount of from about 30 to about 50 percent by weight;

(ii) a second pigment present in an amount of from about 1 to about 15 percent by weight and comprising carbon black;

(iii) a second charge control agent present in an amount of from about 0.1 to about 6 percent by weight and selected from the group consisting of distearyl dimethyl ammonium methyl sulfate and cetyl pyridinium chloride; and (b) a second carrier comprising:

(i) a steel core with an average diameter of from about 25 to about 215 microns; and (ii) a coating selected from the group consisting of chlorotrifluoroethylene-vinyl chloride copolymer containing from 0 to about 40 percent by weight of carbon black at a coating weight of from about 0.4 to about 1.5 percent by weight of the carrier, and polyvinylfluoride at a coating weight of from about 0.01 to about 0.2 percent by weight of the carrier;

(5) transferring the developed two-color image to a substrate; and (6) permanently affixing the image to the substrate.

60. A process according to claim 59 wherein the black second toner contains colloidal silica present in an amount of from about 0.1 to about 2 percent by weight of the toner, wherein the silica is present on the surface of the toner.

61. A process according to claim 59 wherein the black second toner contains zinc stearate present in an amount of from about 0.1 to about 2 percent by weight, wherein the zinc stearate is present on the surface of the toner.

62. A process according to claim 59 wherein the black second toner contains colloidal silica present in an amount of from about 0.1 to about 2 percent by weight of the toner, wherein the silica is present on the surface of the toner, and zinc stearate present in an amount of from about 0.1 to about 2 percent by weight, wherein the zinc stearate is present on the surface of the toner.

63. A process for forming two-color images which comprises (1) charging an imaging member in an imaging apparatus; (2) creating on the member a latent image comprising areas of high, intermediate, and low potential; (3) developing the low areas of potential with a developer comprising a colored first toner comprising a first resin selected from the group consisting of polyesters, styrene-butadiene polymers, styrene-acrylate polymers, styrene-methacrylate polymers, and mixtures thereof; a first pigment; a charge control agent; colloidal silica surface external additives present; and external additives comprising metal salts or metal salts of fatty acids; and a first carrier comprising a core and a coating selected from the group consisting of methyl terpolymer, polymethyl methacrylate, and a blend of from about 35 to about 65 percent by weight of polymethylmethacrylate and from about 35 to about 65 percent by weight of chlorotrifluoroethylene-vinyl chloride copolymer, wherein the coating contains from 0 to about 40 percent by weight of the coating of conductive particles; (4) subsequently developing the high areas of potential with a developer comprising a black second toner comprising a second resin present selected from the group consisting of polyesters, styrene-butadiene polymers, styrene-acrylate polymers, styrene-methacrylate polymers, and mixtures thereof; a second pigment; and a second charge control additive; and a second carrier comprising a core and a coating selected from the group consisting of chlorotrifluoroethylene-vinyl chloride copolymer containing from 0 to about 40 percent by weight of conductive particles; polyvinylfluoride; and polyvinylchloride; and (5) transferring the developed two-color image to a substrate.

64. A process according to claim 63 wherein the low areas of potential and the high areas of potential of the latent image are developed by conductive magnetic brush development.

65. A process according to claim 63 wherein the first carrier comprises a steel core.

66. A process according to claim 63 wherein the second carrier comprises a steel core.

67. A process according to claim 63 wherein the high level of potential is from about −750 to about −850 volts, the intermediate level of potential is from about −350 to about −450 volts, and the low level of potential is from about −100 to about −180 volts.

68. A process according to claim 63 wherein the levels of potential are separated by from about 100 to about 350 volts.

69. A process according to claim 63 wherein the first resin is present in an amount of from about 80 to about 98.8 percent by weight of the colored first toner and the first pigment is present in an amount of from about 1 to about 15 percent by weight of the colored first toner.

70. A process according to claim 63 wherein the second resin is present in an amount of from about 80 to about 98.8 percent by weight of the black second toner and the second pigment is present in an amount of from about 1 to about 15 percent by weight of the black second toner.

* * * * *

UNITED STATES PATENT AND TRADEMARK OFFICE
Certificate

Patent No. 4,948,686

Patented: Aug. 14, 1990

On petition requesting issuance of a certificate for correction of inventorship pursuant to 35 USC 256, it has been found that the above-identified patent, through error and without and deceptive intent, improperly sets forth the inventorship.

Accordingly, it is hereby certified that the correct inventorship of this patent is Ronald J. Koch, Robert J. Gruber, Paul C. Julien, Donald J. Goodman, Edward J. Gutman, Deepak R. Maniar, Roger N. Ciccarelli and Denise R. Leon-Bayley.

Signed and Sealed this Nineteenth Day of November 1991.

MARION E. MC CAMISH

*Supervisory Patent Examiner*
*Art Unit 157*